US007959154B2

(12) United States Patent
Ball

(10) Patent No.: US 7,959,154 B2
(45) Date of Patent: Jun. 14, 2011

(54) TARGET STAND

(76) Inventor: Terry Ball, Dayton, NV (US)

( * ) Notice: Subject to any disclaimer, the term of this patent is extended or adjusted under 35 U.S.C. 154(b) by 0 days.

(21) Appl. No.: 12/145,448

(22) Filed: Jun. 24, 2008

(65) Prior Publication Data

US 2009/0315265 A1 Dec. 24, 2009

(51) Int. Cl.
*F41J 1/10* (2006.01)

(52) U.S. Cl. ..... 273/407

(58) Field of Classification Search ..... 273/398–410; 248/371, 454, 463–465
See application file for complete search history.

(56) References Cited

U.S. PATENT DOCUMENTS

| | | | | | |
|---|---|---|---|---|---|
| 429,942 | A | | 6/1890 | McBride | |
| 1,364,010 | A | | 12/1920 | Tyerman | |
| 2,099,908 | A | | 6/1936 | Rosengarten | |
| 2,048,155 | A | * | 7/1936 | Armantrout | 273/407 |
| 2,069,822 | A | | 2/1937 | Douglas | |
| 3,087,701 | A | | 4/1963 | Wallace | |
| 3,415,519 | A | * | 12/1968 | Hand | 273/407 |
| 3,836,144 | A | * | 9/1974 | Mahoney | 473/435 |
| 4,029,318 | A | | 6/1977 | Boss | |
| 4,415,149 | A | * | 11/1983 | Rees | 248/454 |
| 4,546,984 | A | | 10/1985 | Towle et al. | |
| 4,811,956 | A | | 3/1989 | Foreman | |
| 5,145,133 | A | * | 9/1992 | France | 248/168 |
| 5,280,920 | A | | 1/1994 | Knapper, II | |
| 5,570,889 | A | | 11/1996 | Tyrer | |
| 5,678,824 | A | | 10/1997 | Fortier et al. | |
| 5,829,753 | A | | 11/1998 | Wiser | |
| 5,906,552 | A | * | 5/1999 | Padilla | 473/421 |
| 5,967,523 | A | * | 10/1999 | Brownlee | 273/407 |
| 6,435,512 | B1 | | 8/2002 | Beckwith, Sr. | |
| 6,491,303 | B1 | * | 12/2002 | Huston | 273/407 |
| 6,543,778 | B2 | * | 4/2003 | Baker | 273/407 |
| 6,880,828 | B2 | * | 4/2005 | Liao | 273/395 |
| 7,175,181 | B1 | | 2/2007 | Bateman et al. | |
| 2007/0045965 | A1 | | 3/2007 | Bateman et al. | |

* cited by examiner

*Primary Examiner* — Mark S Graham
(74) *Attorney, Agent, or Firm* — Ian F. Burns & Associates, P.C.

(57) ABSTRACT

A target stand is disclosed that comprises a target frame supported on a shelf having a pair of legs mounted in spaced relation. The legs pivotal and adjustable between a storage position and a shooting position. The storage position having the target frame intermediate to and parallel to the legs. The shooting position having the legs in a generally non-parallel configuration to support the target frame in a predetermined shooting position. The target frame supporting a target either above or below the pivotal connection between the legs and the target frame. The legs adapted to be secured to the target frame thus resisting pivoting and adjusting to hold the legs in a non-symmetrical orientation to accommodate rough terrain.

8 Claims, 4 Drawing Sheets

TARGET STAND

FIELD OF THE INVENTION

The present invention relates to a frame or supporting device for a target or the like. The device is comprised of a frame for surrounding and securing the target. The base of the frame has members attached on both sides which may be pivoted to either lay flush with the frame or swing down to create an A-shaped stand for the frame. The pivot joint includes a nut or the like which may be loosened to move the frame members and tightened to secure them in place.

BACKGROUND

Target shooting at targets of various kinds with rifles, handguns, shotguns, and/or a bow and arrow is a popular sport involving shooting at targets generally made of paper having shapes such as a bullseye or game animal or predator thereon. Shooting at a target as a test of skill has its origins with archery, and it was not until much later, after the advent of firearms, that target shooting with firearms became commonplace. Today, target shooting is a very popular and competitive activity.

Target shooting can involve shooting at either moving targets or stationary targets. With respect to stationary targets, a target is placed at a distance. The angle of the target face with respect to the shooter is important to improve and measure the skill of the shooter. The shooter generally shoots at the target a number of times, removes and replaces the target with another target. The target needs to be supported or suspended above the ground so that it may be shot. The support for shooting on uneven terrain may need adjustable components to hold the target in a fixed, predetermined position and angle relative to the shooter. Accordingly, the prior art has provided an array of apparatus or stands which may be operative for supporting or suspending a target to be shot. However, these apparatus are not easily carried or transported from place to place and suffer from additional structural shortcomings which necessitate certain new and useful improvements.

Prior art target stand have legs that can be driven into the earth for support and may include a target feed system comprising a continuous roll of targets mounted on and between the legs for supplying a user with fresh targets which are successively placed into shooting position. Legs that must be driven into the earth for supporting the stand cannot be used on relatively impenetrable surfaces such as rock, asphalt, or perhaps concrete.

Other apparatus incorporate upstanding frameworks which generally include a base having a pair of upstanding legs for supporting a target therebetween. The target can be either rigidly mounted or pivotally mounted, and some of the frameworks are collapsible, incorporating a plurality of fasteners used for erecting the framework as needed. However, these frameworks are not easily assembled and reassembled, normally sustain severe damage from incoming projectiles due to the close proximity of the target to the framework, and incorporate many separate parts which may not be easily repaired or replaced if broken.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to fold into a compact shape for easy transport and storage adjust legs to change the height of the target;

adjust each leg independently to hold the target on uneven terrain;

adjust the angle of the target with respect to the position of the shooter; and provide a lightweight collapsible target stand that can be easily stored and transported.

These and other advantages may be realized by reference to the remaining portions of the specification, claims, and abstract.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF ONE EMBODIMENT OF THE PRESENT INVENTION

The present invention provides a folding target stand for holding a target in a shooting position on rough terrain. The target stand has a support shelf. The support shelf having a first end and a second end, a first pivot bar on the first end and a second pivot bar on the second end. A first leg assembly having a foot portion is releasably, pivotally connected to the support shelf having the foot portion spaced from the support shelf. A second leg assembly is releasably and pivotally connected to the support shelf in spaced relation to the first leg assembly. A target frame on the support shelf is configured to receive a target and hold the target in a shooting position.

The first and second leg assemblies each have a respective first support pivotally connected to the support shelf at first pivot bar and a respective second leg pivotally connected to the support shelf at the second pivot bar. The first and second leg assemblies are adapted to pivot about the pivotal connection to a storage position wherein the first and second leg assemblies are parallel to target frame. The legs are further adapted to be secured to the target frame at the pivotal connection, thus resisting pivoting and adjusting to hold the legs in a non-symmetrical orientation to accommodate rough terrain.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
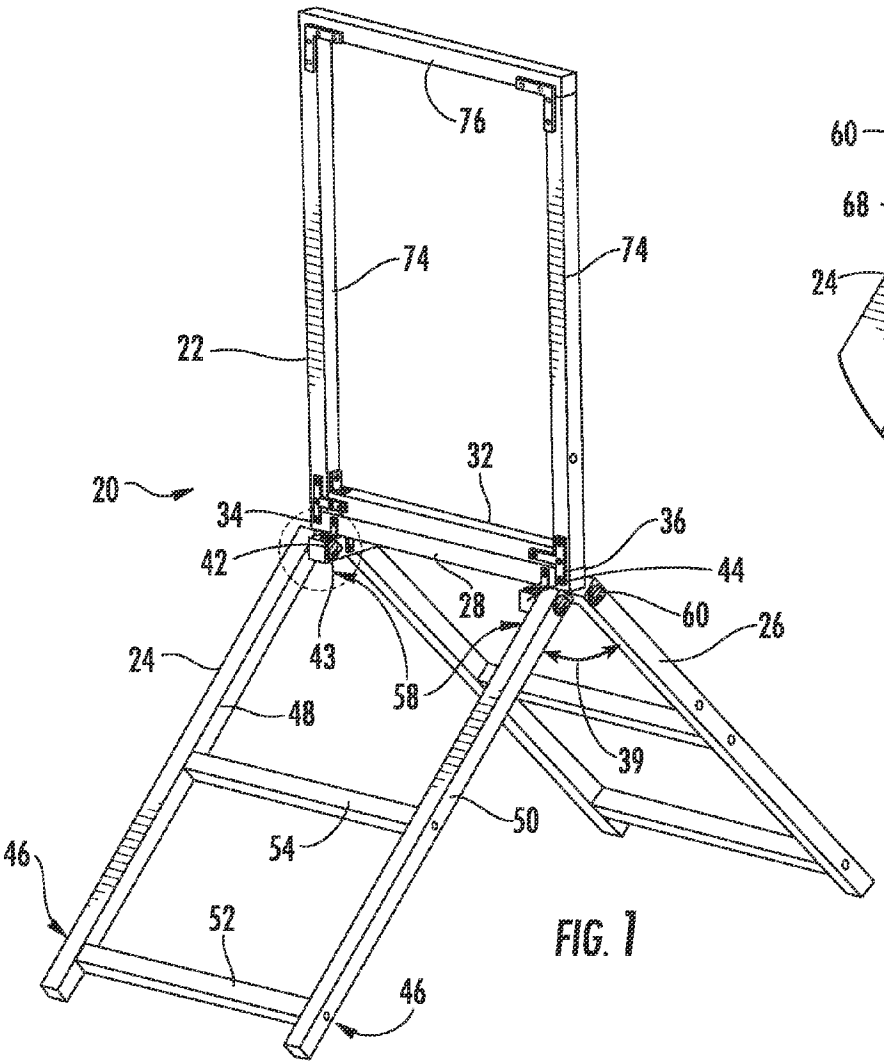
FIG. 1 is substantially a perspective view of one embodiment of the target frame in erected form of the present invention.
Figure 6:
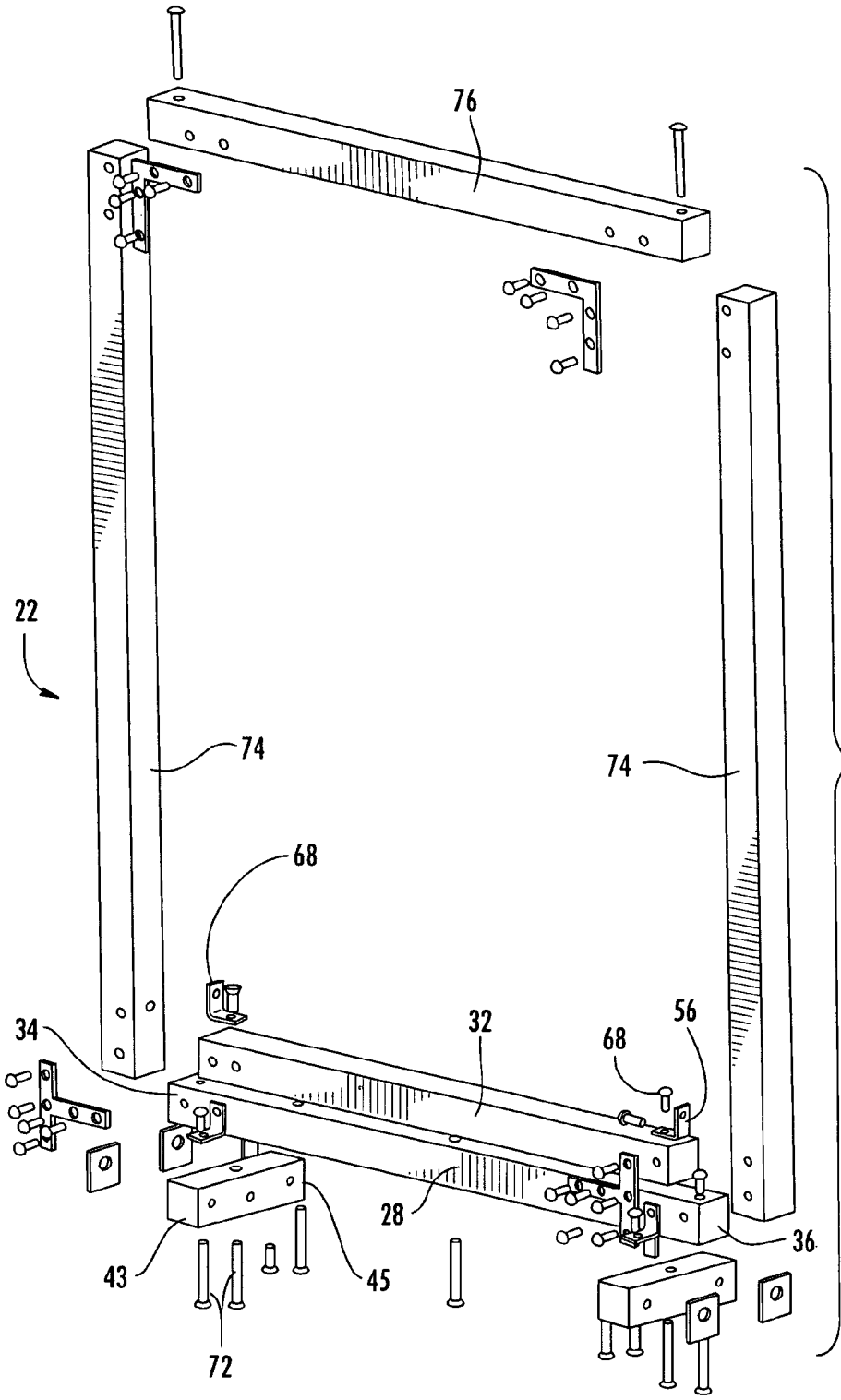
FIG. 6 is an exploded plan view of the target frame of the target stand.

Referring to FIG. 1, the present invention comprises a target stand, generally indicated by reference number 20. Target stand 20 comprises a target frame 22, a first leg assembly 24, second leg assembly 26 and support shelf 28. Support shelf 28 may be attached to target frame 22 at inner target frame member 32. Support shelf 28 has a first end 34 and a second end 36. First pivot bar 42 is attached to support shelf first end 34 and disposed perpendicular to support shelf 28. Second pivot bar 44 may be attached to support shelf second end 36 and in this embodiment the second pivot bar is shown disposed perpendicular to support shelf 28 and parallel to first pivot bar 42. First pivot bar 42 has a first pivot end 43 and a second pivot end 45 (FIG. 6). The pivot ends 43, 45 (FIG. 6) are shown in this embodiment spaced from the support shelf 28 to pivotally attach to first and second leg assemblies 24, 26 and hold the leg assemblies 24, 26 in spaced relation. First pivot bar 42 may be attached to support shelf first end 34 and likewise pivotally attached to first legs of first and second leg assemblies 24, 26. Target frame 22 may be positioned extending away from leg assemblies 24, 26 for holding a target 38 (FIG. 7) above or may hang from support shelf to hold the target 38 (FIG. 7) in a low position. Leg assemblies 24, 26 are adapted to be pivoted about their connections to non-predetermined angular relationship 39 to support the target frame 22 in spaced relation to the ground (FIG. 7) where the ground may be uneven.

Figure 4:
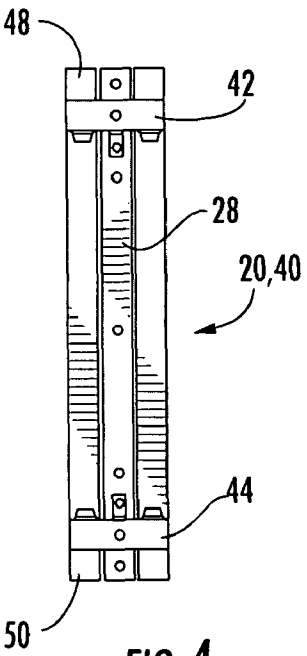
FIG. 4 is a top plan view of the target stand in a stored state.
Figure 3:
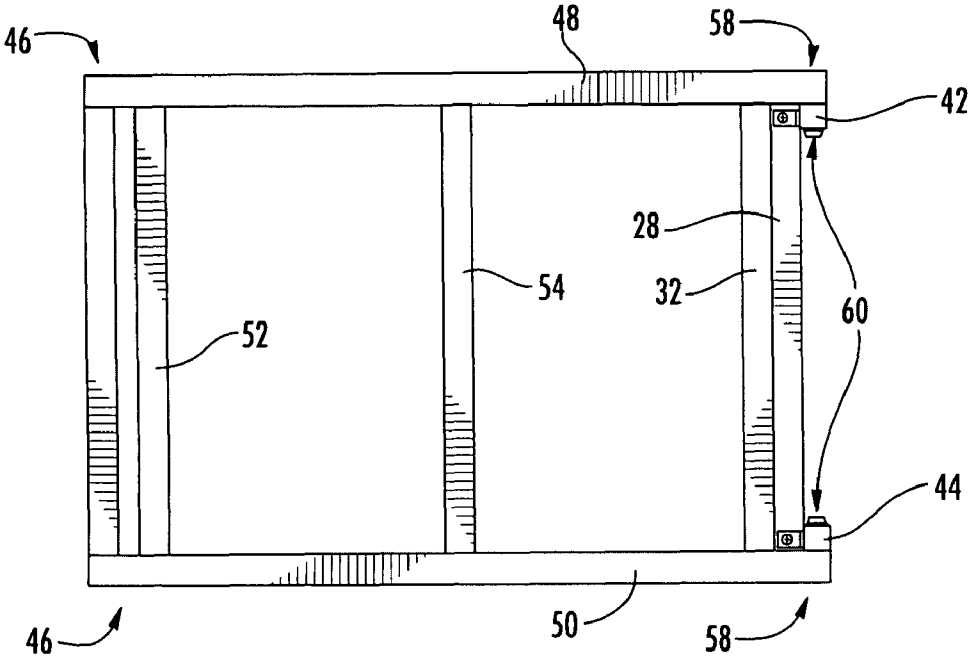
FIG. 3 is a front plan view of the target stand in a stored state.
Figure 2:
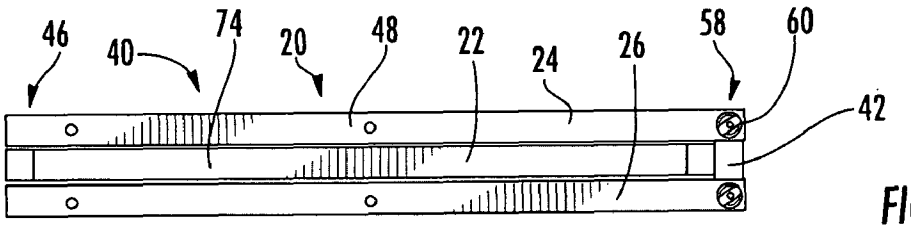
FIG. 2 is a side plan view of the target stand in a stored state.

Referring to FIGS. 2-4, leg assemblies 24, 26 may pivot to a storage position 40. In storage position 40, leg assemblies 24, 26 can pivot to a position parallel to target frame 22. In storage position 40, foot portions 46 on leg assemblies 24, 26 are adjacent in this embodiment to outer target frame member 76. Leg assembly 24 may be substantially like leg assembly 26 (FIG. 2). Leg assembly 24 comprises first support 48, second support 50, outer cross member 52 and middle cross member 54. First and second supports 48, 50 comprise foot portion 46 and pivot end 58 connected to the respective pivot bar 42, 44. It should be understood, outer cross member 52 is generally adjacent foot portion 46 and pivot end 58 is likewise adjacent pivotal connection 60 joining leg assembly 24 to pivot bars 42, 44 in the embodiment shown. Pivot bars 42, 44 may form the top of the target stand 20 in the stored position 40. First support 48 can be pivotally connected to first pivot bar 42 and second support 50 can likewise be pivotally connected to second pivot bar 44. Leg assembly 26 may be similarly connected to pivot bars 42, 44. Target frame 22 may be stored and transported intermediate leg assemblies 24, 26. Closed position 40 in this embodiment, has a generally rectangular top profile.

Figure 5:
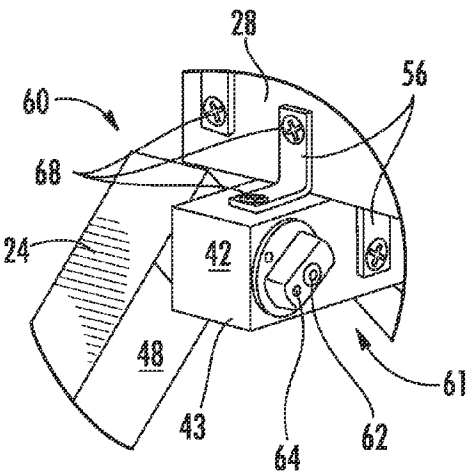
FIG. 5 is a perspective view of a pivotal connection on a pivot bar.

Referring to FIG. 5, releasable connection 61 may pivotally attach leg assembly 24 at first support 48 to first pivot bar 42. Releasable connection 61 may comprise a pivotal fastener such as bolt 62 and mating fastener such as wing nut 64. Pivotal connection between first support 48 and first pivot bar 42 may be configured to hold the first support 48 perpendicular to support shelf 28 and allows first support 48 to rotate about the axis of the support bar 28 for positioning at a desired angular orientation with respect to target frame 22 wherein fastener 64 and bolt 62 can be tightened to compress the first support to the first pivot bar 42 to hold the angular position 39 (FIG. 1). Support shelf 28 may be attached to first pivot bar 42 by angle iron 56 held in place by fasteners such as screws 68. It should be understood, the first and second supports 48, 50 of the first and second leg assemblies 24, 26 are each pivotally connected to the target stand in a similar manner.

Referring to FIG. 6, support shelf 28 may be attached to target frame 22 at inner target frame member 32 by fasteners such as screws 72. Inner target frame member 32 may be attached at each end to side target frame members 74 extending away from support shelf 28 and terminating at outer target frame member 76. Angle irons 56, secured with fasteners such as screws 68, may be used between side members 74 and inner target frame member 32 and outer target frame member 76 for secure attachment.

Figure 7:
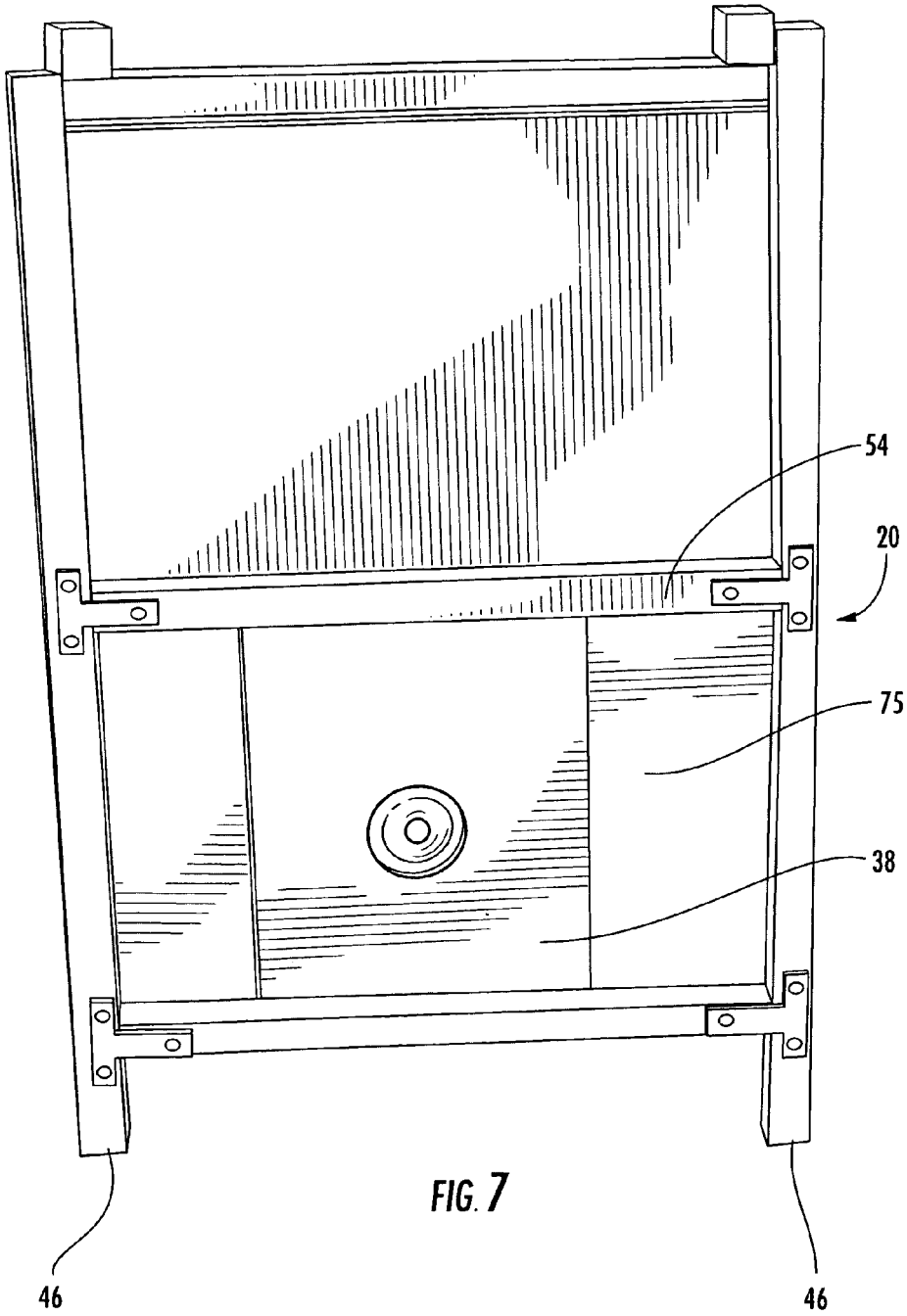
FIG. 7 is a front plan view of the target stand having the target in a low position.

Referring to FIG. 7, target 38 may alternatively be positioned to hang from support shelf 28 between leg assemblies 24, 26 for holding the target 38 in a low position. Target 38 is visible between the middle and outer cross members 54, 52 respectively. Target frame 22 may have a support board 75 for mounting target 38 thereon. Foot portions 46 are positioned to engage a surface such as the ground or a rock or table (not shown) to hold the target frame 22 above the ground. The angle 39 (FIG. 1) between first and second leg assemblies 24, 26 may be adjustable to hold the target frame in spaced relation to the ground.

In use, target stand 20 is transported to a shooting site in the storage position 40. A target 38 can be mounted on the target frame 22. Wing nuts 64 are loosened to allow leg assemblies 24, 26 to pivot into a position having the respective foot portions 46 spaced from each other for stability. The foot portions 46 of the respective leg assemblies 24, 26 may be positioned to engage the ground and may be adapted by angular adjustment with respect to the target frame 22 to support the target frame 22 in the desired position on rough terrain. The wing nuts 64 are tightened to secure the desired position of the target 38.

The target stand 20 comprises the leg assemblies 24, 26 and target frame 22 pivotally connected but moving independently of each other. This allows the target stand 20 to be level on any terrain. In the folded position 40, the target 38 rests between the leg assemblies 24, 26 and is secured there by tightening the releasable connection 61 at wing nuts 64. To open the target stand 20, the wing nuts 64 are loosened allowing both leg assemblies 24, 26 to swing open into any position and allowing the target stand 20 to stand upright on any sloping or flat terrain. Once legs 24, 26 are adjusted to the terrain, the target stand 20 is level and the wing nuts 64 are tightened. The pivot bars 42, 44 holding the leg assemblies 24, 26 in spaced relation to each other and to the target stand accommodate the parallel relation positioning for storage and transportation and the quick opening and positioning of the legs 24, 26 to level the target stand 20 on rough terrain.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A target stand comprising:

(A) a support shelf, the support shelf having a first end and a second end, a first pivot bar on the first end and a second pivot bar on the second end, the first and second pivot bars being disposed perpendicularly to the first and second ends of the support shelf and configured to form a pivotal connection at each end of the support shelf;

(B) a first leg assembly, the first leg assembly releasably pivotally connected to the first and second pivot bars, the first leg assembly having a foot portion spaced from the support shelf;

(C) a second leg assembly releasably and pivotally connected to the first and second pivot bars, the second leg assembly held in spaced relation to the first leg assembly;

(D) a target frame detachably supported on the support shelf such that the target frame is removable from an assembly comprising the support shelf, the first pivot bar and the second pivot bar; and (E) wherein the first leg assembly further comprises a first support connected to the first pivot bar and a second support pivotally connected to the second pivot bar wherein first leg assembly pivots about the pivotal connection to a storage position parallel to the target frame.

2. The invention of claim 1 further comprising the target frame adapted to be positioned in a fixed position above the support shelf, the support shelf above at least one of the first and second leg assemblies, the foot portion of the first leg assembly bearing against a surface for holding the target frame above the surface.

3. The invention of claim 1 wherein the pivotal connections are adapted to pivot the first leg assembly and second leg assembly to a position having the target frame above the support shelf.

4. The invention of claim 1 wherein the pivotal connections are adapted to pivot the first leg assembly and second leg assembly to a position having the target frame below the support shelf.

5. The invention of claim 1 wherein the second leg assembly further comprises a first support connected to the first pivot bar and a second support pivotally connected to the second pivot bar wherein second leg assembly pivots about the pivotal connection to a storage position parallel to target frame having target frame intermediate first leg assembly and second leg assembly.

6. The invention of claim 1 wherein the first leg assembly further comprises a cross member connecting the first support to the second support.

7. The invention of claim 5 further comprising a plurality of cross members connecting the first support and the second support on the first leg assembly and a plurality of cross members connecting the first support and the second support on the second leg assembly.

8. The target stand of claim 1 wherein the first and second supports each comprise:

(A) a foot portion; and (B) a pivot end, wherein the pivot end is connected to the respective pivot bar.

* * * * *